United States Patent [19]

Horn

[11] 4,068,908

[45] Jan. 17, 1978

[54] WRITING-TABLE AND MACHINE-TABLE COMBINATION

[76] Inventor: Dieter Horn, Backnanger Str. 40, D-7062 Rudersberg, Germany

[21] Appl. No.: 659,028

[22] Filed: Feb. 18, 1976

[30] Foreign Application Priority Data

Nov. 27, 1975 Germany ..... 7504835

[51] Int. Cl.[2] ..... A47F 5/08

[52] U.S. Cl. ..... 312/30; 312/28; 312/208

[58] Field of Search ..... 312/22, 28, 29, 30, 312/204, 208, 246

[56] References Cited

U.S. PATENT DOCUMENTS

| | | | |
|---|---|---|---|
| 2,499,713 | 3/1950 | Bargen | 312/208 |
| 2,676,860 | 4/1954 | Lemos | 312/208 |
| 2,695,831 | 11/1954 | Sigal | 312/246 |
| 3,524,689 | 8/1970 | Wener | 312/208 |

*Primary Examiner*—Casmir A. Nunberg
*Attorney, Agent, or Firm*—John Holtrichter, Jr.

[57] ABSTRACT

A table having a table top writing surface and adapted to house a concealed sewing machine and the like until needed, the table including a movable machine storing drawer having a lower surface above the normal knee level which sloped downward toward the rear, the machine being mounted on a plate arranged in the drawer with a lifting mechanism that moves the plate flush with the table top when the drawer is in its extended position and that moves the plate downward to bring the machine into a position within the drawer to allow the drawer to be pushed into its retracted position beneath the table top.

6 Claims, 6 Drawing Figures

WRITING-TABLE AND MACHINE-TABLE COMBINATION

The present invention relates to a writing-table with a drawer arranged underneath the table plate.

A writing-table is known which comprises a typewriter which is arranged underneath the writing-table top on a plate guided in a suitable mechanism and which has its lower portion hidden by a roll-up mechanism. The table plate is subdivided into two portions, and the front portion can be tilted upwards so as to create a free area into which the typewriter can be raised so that the plate carrying the typewriter remains at a level somewhat lower than the writing-table top. However, a disadvantage of this known design lies in the fact that in the closed condition the roll-up mechanism hinders the user while in the open condition it leaves the typewriter visible. Moreover, the design described above is suited only for accommodating such machines which in use do not require much space so that the whole writing-table top need not necessarily remain in tact. A particular disadvantage in this known design must, however, be seen in the fact that it is suited only for offices but not for private homes. But especially for this latter application it has often been desired to have an attractive piece of furniture that could be used in different manners and which, in particular, could also accommodate machines such as sewing machines or knitting machines, in a discreet and elegant manner.

It is the object of the present invention to improve a writing-table in such a manner as to make it adaptable to different uses, while assuring that such improvements for such other uses do not impair its appearance and that the different arrangements for the other uses do not trouble or hinder the user when using the writing-table in one particular manner.

According to the present invention, this object is solved in that the bottom of a drawer slopes from the normal height of the front plate towards the rear, the inclination being such that when viewed in the usual manner the bottom remains invisible and that the bottom is above normal knee level, in that a machine, in particular a sewing machine, is mounted on a plate and arranged in the drawer and in that a lifting mechanism is provided which in its one end position brings the plate in flush relationship with the writing-table top and which, in its other end position, brings the machine in a position within the drawer in which the drawer can be pushed underneath the writing-table top.

A particular advantage of the furniture of the invention is that it satisfies its various functions without sacrificing the attractive appearance or without the necessity of compromises in view of the different functional purposes. A particular advantage resides in the fact that when the machine, for instance a sewing, knitting or drawing machine or the like, is in the operating position, the plate carrying such machine is flush with the writing-table top, so that a flat, enlarged writing-table surface is achieved, a fact which is felt to be particularly agreeable and advantageous in connection with sewing or knitting machines, because the knitted and/or sewn webs are supported by an additional surface forming the direct and level extension of the working surface proper.

Compared to these advantages, the mechanism itself is rather simple, as will be explained later. The inclination of the sloping bottom and/or the sloping portion of the bottom can easily be selected to ensure that when viewed from a distance of several meters - equalling the maximum possible in private living rooms - the inclined bottom remains still invisible. Moreover, the inclined bottom hides itself in the dark area underneath the writing-table. In addition, the sizes of the bottom are such to assure that a user sitting and working at the writing-table has sufficient freedom of movement for his knees and legs.

The bottom portion of the drawer can be fixedly mounted. However, in a preferred embodiment of the invention, the drawer portion adjacent the front plate can be moved, in particular tilted, upwards in a position in which even its rear position comes to lie above knee level, when the machine is in its upper (operating) position. The advantage of this arrangement lies in the fact that sufficient liberty of movement for the knees is maintained even when the drawer is extended - in which case the user will normally sit closer to the table than when using it as a writing-table - and when the space available is just sufficient when the table is used as a writing-table. This gives due consideration to the fact that a person using a table as a writing-table will normally sit a little farther away than when using a machine, as for instance a knitting or sewing machine.

In certain embodiments of the invention, the plate may be arranged for movement within the drawer. In preferred embodiments of the invention, however, the plate is rigidly fastened to the drawer, while the machine is mounted at the plate for swinging movement. In this case, the drawer is in its extended position retained by the mechanism in the two end positions relative to the table. The adjustment from one end position to the other is effected manually following the pulling-out or prior to the pushing-in of the drawer. In another embodiment of the invention, the plate is rigidly fixed to the drawer front plate, while the machine is likewise mounted at the plate for swinging movement; in this case, the plate with the drawer front fastened thereto are retained by the mechanism in the two end positions, relative to the remaining drawer parts, when the drawer is in the extended position. In this case, the movement into the two end positions is preferably effected by hand, too. However, one may also provide a drive for the mechanism which is rendered effective shortly before the extended position is reached and/or at the beginning of the sliding-in movement.

The mechanism may be of the most different designs, provided it permits to reach and retain the two desired end positions and provided it requires only little space. In a preferred embodiment of the invention, which fulfills both these requirements, the plate or the drawer have mounted to their sides swinging plates which in the one position — in which the plate lies within the level of the writing-table top — rest on supporting strips and which can be moved against the action of a spring into another position in which they come to lie beside said supporting strips.

This design provides the advantage that the mechanism is of particularly simple design so that its costs make themselves hardly felt, the entire mechanism consisting of 2 supporting strips, two swinging plates and two articulations with springs. And the latter could even be avoided, too, if the swinging plates were arranged to ensure that their weight alone can swing them into the desired one end position.

In another embodiment of the mechanism, the drawer has mounted at its side a lifting lever comprising an inclined face which coacts with a counter-face provided at the drawer, the dimensions and the arrangement of the inclined face being such that the resulting lifting height corresponds approximately to the thickness of the writing-table top. In this case, the lifting lever may be mounted for swinging or longitudinal movement. And it is also possible to use one lifting lever for actuating the inclined surfaces provided on both sides of the drawers. In general, however, each side of the drawer will be provided with one lifting lever.

In still another embodiment of the invention the plate or the drawer comprise inclined faces, whereas the bolts are provided at the drawer or the table which in the end portion of the extension movement project into the path of movement of the said inclined faces which in turn are terminated by stop notches. In general, these inclined faces and stop notches will be provided at all four corners. Both inclined faces and stop notches are worked into a metal part. In cases where only the plate can be lifted, the bolts are arranged at the drawer side wall and the inclined faces are provided at the plate; in cases where the whole drawer can be lifted, the inclined faces are arranged at the drawer and the bolts are provided at the table side-wall. It goes without saying that the arrangement of the bolts and inclined faces with stop notches can be exchanged. In a preferred improvement of this embodiment, the stop notches can be covered by a swinging slide. In this case the arrangement is such that in the one movement a dead centre is first exceeded, whereupon the stop notch comes into action. In the opposite movement, too, a dead centre is initially exceeded whereupon an inclined face of the swinging slide comes into engagement with the bolt. When this inclined surface has been overcome, the plate or drawer falls back into its lower guide way in which the drawer can be finally pushed into the writing-table.

The above discussed and other objects, features and advantages of the present invention will become more apparent from the claims and the following description of the embodiments shown in the accompanying drawings, in which FIG. 1 shows a perspective view of the writing-table according to the present invention;

Figure 1:
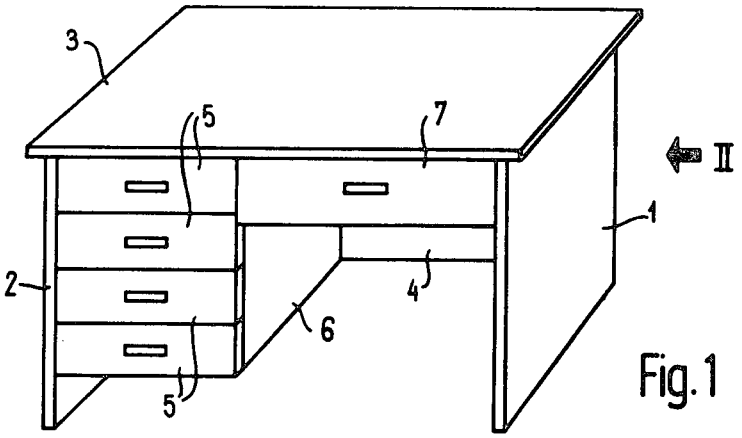

The writing-table shown in FIG. 1 comprises two sides 1 and 2 which take the form of plates and which carry a table top 3. The sides 1 and 2 are rigidly connected by the said table plate 3 and, in addition, by a rear wall 4. Arranged adjacent the side plate 2 are four superposed drawers 5 guided in a box. The side-wall 6 of this box, which faces the side 1, is shown in FIG. 1. Between the uppermost one of the said drawers 5 and the side plate 1 there is arranged directly underneath the table plate 3 a machine drawer 7 which is supported in guides provided on the one hand at the side-wall 6 and, on the other hand, at the side plate 1.

When the furniture shown in FIG. 1 is used as a writing-table, the user sits in front of the machine drawer 7 and the space delimited by the side-wall 6 and the side plate 1 at the side, by the rear wall 4 at the back and by the bottom of the machine drawer 7 at the top, provides the necessary freedom of movement for the feet and legs.

Contrary to usual drawers and contrary to the drawers 5, the machine drawer 7 comprises a bottom sloping from the front plate 8 in FIG. 1 towards the rear wall 4. The said bottom consists of a front swinging bottom 9 and a rear fixed bottom 10. The swinging bottom 9 is mounted at a cross plate 11 for swinging movement about a horizontal axis 12. Although the cross plate 11 rests flat against the inside of the front plate 8, it is not fastened to the latter, but rather to the side-walls 13 of the machine drawer 7. The end of the swinging bottom 9 opposite the axis 12 rests on the fixed bottom 10. In another possible end position of the swinging bottom 9, the latter occupies an essentially horizontal position, wherein it is retained by spring detention means (not shown).

Mounted to the side-walls 13 of the machine drawer 7 are guiding supports 14 which coact with guides (not shown in detail) mounted at the side plate 1 or the side-wall 6. The interior of the machine drawer 7 is further delimited by a rear wall 15. The front plate 8 has rigidly mounted to it a machine plate 16 provided with a recess 17. A machine, for instance a flat-bed sewing machine, is mounted in the known manner at that edge 18 of the recess 17 which lies adjacent the table top 3 when the machine drawer 7 is in the extended position. The machine can be moved upwards until its base plate comes to lie in one level with the machine plate 16. For this purpose, a swinging rail 20 is supported at the edge 19 opposite the edge 18 of the recess 17, which swinging rail is moved upwards with the machine when the latter swings upwards, whereupon it moves back together with the machine bed to the level of the machine plate 16. Mounted to the side of the machine plate 16, in parallel with the side-walls 13, are swinging plates 21 whose inner sides, which face each other, coact each with one leaf spring 22 which tend to force the swinging plate 21 outwardly. When the machine plate 16 is gripped and raised a little until it reaches the level of table plate 3, the two leaf springs 22 force the two swinging plates 21 outwardly until they are in contact with the side-wall 13. Each of the side-walls 13 carries on its inside a supporting rail 23 on which rest the swinging plates 21. Thus, the machine plate 16 lies in one plane with the table top 3.

Figure 2:
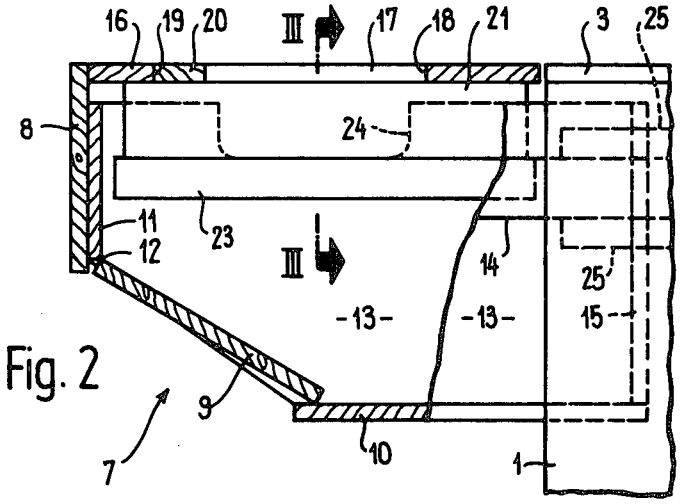
FIG. 2 shows a part-sectioned view, viewed in the direction of arrow II in FIG. 1, in an enlarged scale as compared to FIG. 1, showing the drawer in the extended position.
Figure 3:
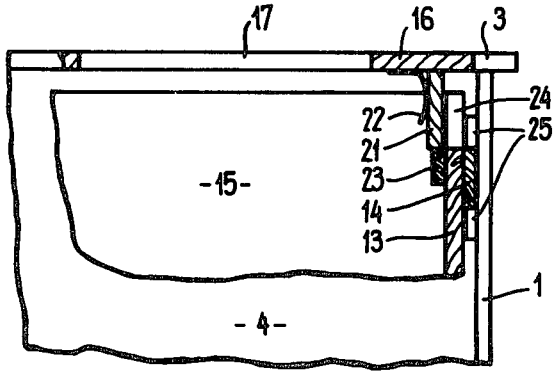
FIG. 3 shows a partial section taken along line III—III in FIG. 2.

In order to move the machine drawer 7 into its retracted position, the user reaches through recesses 24 provided in the side walls 13 and swings the swinging plate 21 against the effect of the leaf spring 22 a little rearwards until it passes the supporting rail 23. Now the machine plate 16 together with the front plate 8 rigidly connected therewith can be lowered a distance exceeding a little the thickness of the table top 3. Thereafter the swinging bottom 9 is moved from its horizontal position into the position shown in FIG. 2, in which its free end rests on the stationary bottom 10, whereupon the machine (not shown) is moved into the machine drawer 7 - unless this has been done before. Finally, the machine drawer 7 may be pushed into the writing-table. In this operation, the guiding supports 14 coact with the guide rails 25 indicated in FIG. 3, which are either mounted at the side plate 1 or, in the same manner, at the sidewall 6.

Figure 4:
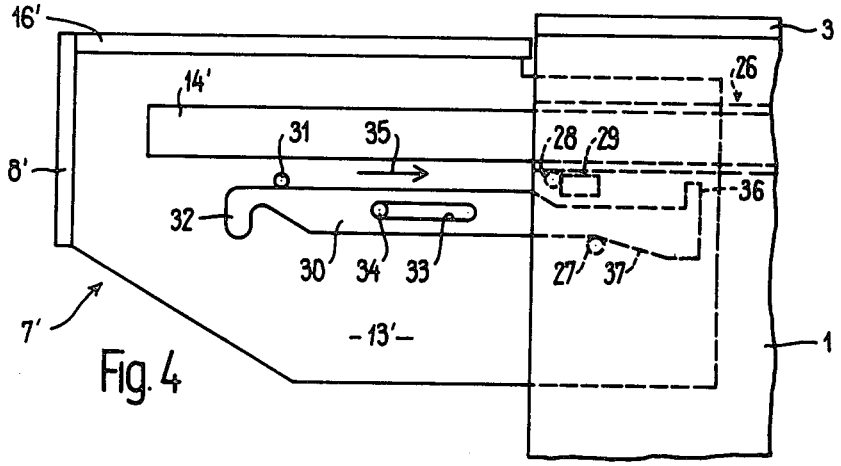
FIG. 4 shows a view of another embodiment, viewed in the direction of arrow II in FIG. 1.
Figure 5:
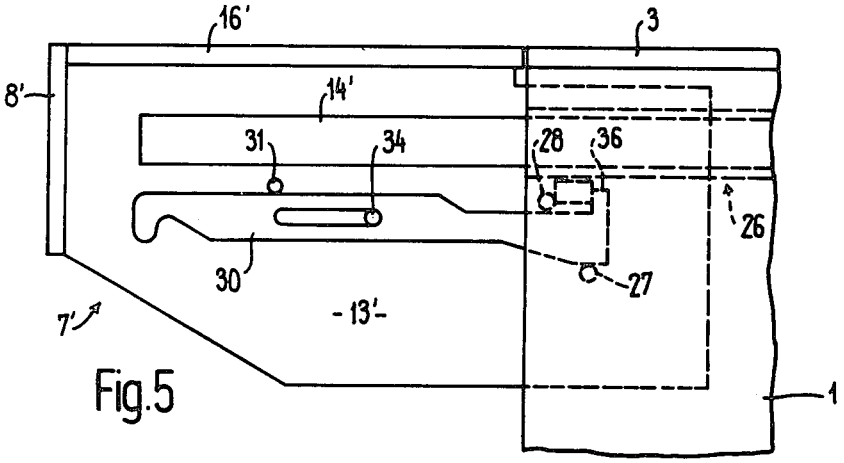
FIG. 5 shows the arrangement of FIG. 4 in the raised position.

In the embodiment shown in a simplified manner in FIGS. 4 and 5, a machine plate 16' is rigidly fastened at the machine drawer 7' and the front plate 8'. Mounted to the side walls 13' are guiding supports 14' each of which coacts with one guide 26 mounted for swinging movement at the side plate 1 or the side-wall 6. The swinging axis lies in the neighbourhood of the plane of the rear wall 4. Mounted to the side plate 1 or the side-wall 6 are two pins 27 and 28 which extend in the direction of the foot space. The side-wall 13' carries a plug-shaped stop 29. The upper one of the two pins 28 serves on the one hand as an extension stop for the machine drawer 7', because the stop 29 comes into engagement with the pin 28. On the other hand, it serves as a rest for the swinging guide 26. The position of the pin 28 has been selected to ensure that the machine plate 16' is immediately beneath the table top 3. Further, a lifting lever 30 is amounted at the side-wall 13' for longitudinal movement. To this end, a bearing pin 31 is fastened in the side-wall 13', against which bears the upper side of the lifting lever 30, the front end of which is provided with a knob 32. In addition, the lifting lever 30 is provided with a slot 33 which coacts with a screw pin 34 which limits the movement of the lifting lever 30 in the direction of arrow 35, when it abuts against the end of the slot 33. The stop for the movement in the opposite direction is provided by a projection 36 which is arranged at the inner end of the lifting lever 30 and which engages the stop 29. The portion of the lifting lever 30 adjacent the inner end with the projection 36 is provided with an inclined face 37 which coacts with the pin 27.

In the position shown in FIG. 4, the machine drawer 7' is fully extended, but the lifting lever 30 is in its retracted position, and the plate 16' is below the plane of the table top 3. For the purpose of raising the machine plate 16', the whole drawer is lifted by pulling the knob 32 of the lifting lever 30 forwardly, i.e. opposite the direction indicated by arrow 35, until the projection 36 comes into engagement with the stop 29, thereby causing the inclined face 37 to slide along the pin 27. And since the pin 27 is rigidly fastened to the side plate 1 or the side-wall 6, the drawer will accordingly be raised. The lifting height is such that at the end of this process the machine plate 16' will be in one plane with the table top 3, as shown in FIG. 5. For the retracting operation, the lifting lever 30 is initially moved in the direction indicated by arrow 35, whereby the drawer will be lowered. Thereafter, the drawer is pushed into the writing-table as usual, after the machine has been retracted or pushed into the drawer in the known manner.

Figure 6:
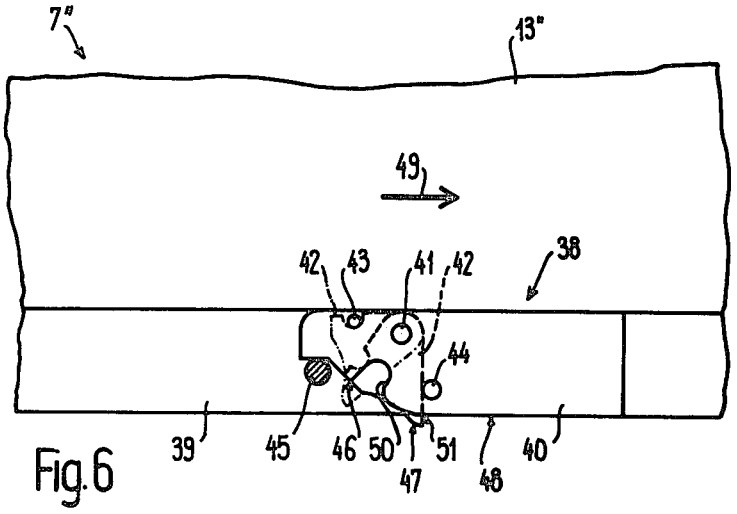
FIG. 6 is a detail drawing of fittings that may be used as lifting mechanism.

The lifting mechanism may have still other designs. For instance, the drawer may be provided at four points with fittings as shown in FIG. 6. To this end, the fitting 38 consisting of sheet metal sections is accomodated in a recess 39 which may, for instance, be worked into the side-wall 13'' of the machine drawer 7'' as a corner groove. The fitting 38 comprises a plate 40 fastened at the drawer side-wall 13'' and a swinging slide 42 mounted at the plate 40 for swinging movement about an axis 41, which swinging slide 41 engages in its one end position a stop pin 43 and, in its other end position, a stop pin 44. Mounted to the side plate 1 or the side-wall 6 is a projecting pin 45 which, at the end of the pull-out movement of the drawer 7'' coacts with an inclined surface 46 provided at the plate 40. Due to the fact that the inclined surface 46 slopes downwardly, this raises the drawer. In the end portion of the inclined face 46, the pin 45 comes into engagement with an inclined face 47, which is provided at the swinging slide 42 and which forms the continuation of the inclined face 46. When the pin 45 reaches the end of the inclined face 47, it falls on to a guiding edge 48 of the plate 40. Thereafter, the drawer is slightly displaced in the opposite direction, i.e. in the direction indicated by arrow 49, so that the pin 45 moves along the guiding edge 48 until it engages a stop recess 50. In this position of the pin 45, the machine plate (not shown) is in one plane with the table top 3. During the movement in the direction opposite the arrow 49, the pin 45 moves the swinging slide 42 back into the position indicated by dotted lines. Now, when the condition of the writing-table shown in FIG. 1 is to be restored and when to this end the drawer 7'' is pushed back into the table after the machine has been moved to the drawer first, the drawer is pushed into the direction indicated by arrow 49, so that the pin 45 disengages the stop recess 50 and slides along an inclined face 51 provided at the swinging slide 42 until it drops along the inclined surface 47 down to the inclined face 46. When the pin 45 has reached the position shown in FIG. 6, the drawer is in a position in which the surface of the machine plate is underneath the table top 3 so that the drawer can be fully pushed in, in the direction of arrow 49. During this operation, the swinging slide 42 returns either automatically into the position indicated by full lines or else it will be returned in this position by the pin 45 at the beginning of the next pull-out movement.

It is obvious that the invention is not limited to the described embodiments, but that variations therefrom are possible without leaving the scope of the invention. In particular, it is possible to employ individual characteristics of the invention either individually or in combination. For example, it is obvious that the most different lifting mechanisms may be employed. In any case, the invention avoids in a very advantageous manner the necessity of providing a cut-out in the table top, which otherwise would require heavy and time-consuming work and, in addition, impair the servicability and appearance of the writing-table. The whole surface of the table top 3 remains in tact as an additional working surface which can be advantageously used when the most different machines are mounted in the machine drawer, because the machine plate comes to lie flush with the table top 3. A further advantage of the present invention lies finally in the fact that the thickness of the machine plate does not depend on the thickness of the table top, which permits the use of standardized fittings for mounting the machine to the machine plate, without the necessity of adapting the thickness of the table top to the thickness of the fittings, a requirement which must be fulfilled when the machine is collapsed through a cut-out in the table top, as in the case of the usual sewing-machine tables.

In a particularly preferred embodiment of the invention, the drawer can be pulled out by approximately two thirds of its depth. Mounted to that third of the drawer which in the pulled-out position remains within the writing-table is a carriage running in ball bearings which in turn run on a rail fixed to the side plates of the writing-table adjacent the drawer. The rail has fitted in its outer end a slotted pin which acts to limit the pull-out movement. This embodiment offers the particular advantage that no guide elements are visible even in the extended position of the machine drawer. Nevertheless, the drawer is safely retained in position and smoothly guided. A particular advantage lies moreover in the fact that the assembly of this guide is very simple. The L-rails at the two side-walls are located by means of a templet and then screwed in position. After the drawer has been inserted, a stop pin serving as limitation for the pullout movement is pressed into a bore provided at the outer end of the L-rail. The assembly of the carriage is likewise very simple. A recess corresponding to the size of the carriage is milled into the side portions. A depth of 1 to 2 mm will suffice. Then the carriage must simply be fastened in this recess in which it is also protected against distortion.

The furniture of the invention is not only suited for the installation of sewing machines, but also for the installation of knitting machines, drawing machines or drawing boards or even writing machines, provided the height of the table top 3 is adapted to the height at which the writing machine is to be used.

Having thus fully disclosed my invention, what I claim is:

1. A writing and machine table combination including a broad-surfaced planar table top and a movable machine drawer slidably disposable in said table below the table top, the invention comprising:

a machine-supporting plate mounted on said machine drawer;

support means associated with said plate for swingably supporting a machine below the upper surface of said plate when not in use and supporting a machine above said upper surface when in use;

positioning means coupled to said drawer for positioning said upper surface of said plate immediately in front and at the level of the upper surface of said table top when said drawer is in its outward extended position; and swingable bottom plate means hingedly attached at the lower-front portion of said machine drawer and normally extending downwardly and rearwardly therefrom for swinging upwardly to a knee-clearing horizontal position when desired.

2. The writing and machine table according to claim 1, wherein said positioning means includes a retaining mechanism operatively coupled to said machine drawer and to said plate, said mechanism including a separate horizontal rail fixedly attached to the inner surface of each of the side walls of said machine drawer, and also including a pair of swingable arms each hingedly attached below said plate and extendable downwardly parallel to and adjacent the inner sides of said machine drawer and resting on an associated one of said supporting rails when said plate is in its upwardly extended position flush with said table top.

3. The writing and machine table according to claim 2, wherein said positioning means also includes bias means in operative communication with said arms and said plate for exerting an outwardly directed force on each of said arms toward said inner surfaces of said side walls of said machine drawer.

4. The writing and machine table according to claim 1, wherein said plate is fixedly attached to said drawer, and said positioning means includes slidable lifting mechanism means associated with an outer surface of a side of said machine drawer and an adjacent inner surface of a side of said table, said latter means including an elongated lifting lever slidably mounted on the side of said drawer and having a lower cam surface with a rearwardly-disposed downwardly inclined cam portion, and also including an inwardly-extending cam pin fixedly attached to said inner surface of said side of said table and in slidable contact with said cam surface for lifting said drawer and said plate when said lifting lever is moved in a forward direction and said inclined cam portion rides on said cam pin.

5. The writing and machine table according to claim 4, wherein said positioning means also includes elongated horizontal guiding supports fixedly mounted to each of the outer surfaces of the sides of said machine drawer, and coacting elongated swingable guides fixedly attached to the inner surfaces of sides of said table adjacent the opposite sides of said machine drawer.

6. The writing and machine table according to claim 1, wherein said plate is fixedly attached to said drawer, and said positioning means includes rotatable lifting mechanism means associated with an outer surface of a side of said machine drawer and an adjacent inner surface of a side of said table, said latter means including four rotatable swinging members mounted adjacent the four corners of said machine drawer and each having a downwardly inclined cam surface associated with a cam pin inwardly projecting from inner surfaces of the table sides adjacent said drawer, each of said cam pins riding on said cam surfaces and lifting said drawer when said drawer is moved outwardly from said table.

* * * * *